US009060556B2

(12) United States Patent
Ploughman

(10) Patent No.: US 9,060,556 B2
(45) Date of Patent: Jun. 23, 2015

(54) TWO (2) SECTION WAIST BELT FOR SIDE ZIPPER STYLE GARMENTS AND THE METHOD OF MAKING THE SAME

(76) Inventor: Penelope Denise Ploughman, Albany, NY (US)

( * ) Notice: Subject to any disclaimer, the term of this patent is extended or adjusted under 35 U.S.C. 154(b) by 360 days.

(21) Appl. No.: 12/928,902

(22) Filed: Dec. 22, 2010

(65) Prior Publication Data

US 2012/0159694 A1 Jun. 28, 2012

(51) Int. Cl.
*A41F 9/00* (2006.01)

(52) U.S. Cl.
CPC ..... *A41F 9/002* (2013.01)

(58) Field of Classification Search
USPC ..... 2/308, 311, 312, 318, 321, 322, 338, 2/96, 101, 304; 24/31 R, 32, 34, 31 B, 24/31 F, 308; 450/95, 119, 134, 135, 140, 450/154
See application file for complete search history.

(56) References Cited

U.S. PATENT DOCUMENTS

| | | | | |
|---|---|---|---|---|
| 723,271 | A * | 3/1903 | Haviland | 2/339 |
| 731,295 | A * | 6/1903 | Forman | 2/312 |
| 1,421,451 | A * | 7/1922 | Garberding | 224/587 |
| D373,011 | S * | 8/1996 | Rippel | D2/627 |
| 7,895,674 | B2 * | 3/2011 | Miller | 2/338 |

* cited by examiner

*Primary Examiner* — Amy Vanatta
*Assistant Examiner* — Sally Haden
(74) *Attorney, Agent, or Firm* — Heslin Rothenberg Farley & Mesiti, P.C.

(57) ABSTRACT

The present invention relates to belts for use with garments such as equestrian riding breeches, pants, trousers, shorts, skirts and the like which have side zippers rather than front zippers. More particularly (but not exclusively), the present invention relates to a versatile and utilitarian two section belt that can be fastened and/or unfastened from more than one position on the wearer's waist (front or side) and that can also be adjusted from either buckle or billet end so as to fit a high, natural, or low waist side zipper garment.

5 Claims, 3 Drawing Sheets

TWO (2) SECTION WAIST BELT FOR SIDE ZIPPER STYLE GARMENTS AND THE METHOD OF MAKING THE SAME

TECHNICAL FIELD OF THE INVENTION

The present invention is in the technical field of wearing apparel and relates generally to belts for use with garments such as equestrian riding breeches, pants, trousers and the like which have side zippers rather than front zippers. More particularly (but not exclusively), the present invention relates to a versatile and utilitarian, two section, belt that can be fastened and/or unfastened from more than one position on the wearer's waist (front or side) and that can also be adjusted so as to fit a high, natural, or low waist side zipper garment.

BACKGROUND OF THE INVENTION

In the field of wearing apparel, traditional belts fasten and/or unfasten in the front of the wearer's waist above the zipper and button or snap. This traditional styling is difficult for the wearer of equestrian riding breeches, pants or trousers with side zippers. These wearers have to remove the belt from the belt loops and in some cases half remove or totally remove the belt from the breeches, trousers, or pants when they need to remove or lower their garment. It is an object of the present invention to provide a leather belt and method of making the same that overcomes the disadvantages and limitations of the prior art. Specifically, the present invention provides a means for adjusting a belt to better fit side-zip garments and provides an easier means of putting on and taking off side zip garments.

Traditional waist belts are made with belting material and hardware manufactured specifically for waist belts and in the standard buckle styles and sizes for apparel. The present invention utilizes leather and hardware specifically made for equine tack rather than apparel. Traditional waist belts have five holes to select from for sizing and these holes are typically placed one inch apart. Accordingly, traditional belts have only three or four inches of possible size adjustment. The present invention has the traditional five holes for size adjustment on the larger billet end (placed one inch apart) and an additional three holes for size adjustment on the smaller billet end (placed three-quarters of an inch apart) thereby providing an additional inch to an inch and one half of size adjustment and a more custom, tailored fit.

SUMMARY OF THE INVENTION

An exemplary embodiment is a belt for use with a garment having a side zipper that is adjustable and versatile so that it can be worn with high, natural, or low waist side zipper garments. Another exemplary embodiment is a belt for use with equestrian side-zip riding breeches. An exemplary implementation includes a method of using a belt with a garment having a side zipper. This method includes positioning the larger buckle and billet at the front of the garment and the smaller buckle and billet end at the side of the garment directly above the side zipper allowing the belt to be fasten or unfastened from either mated buckle and billet end portion.

Further areas of applicability of the present invention will become apparent from the detailed description provided hereinafter. It should be understood that the detailed description and specific examples, while indicating at least one exemplary embodiment of the invention, are intended for purposes of illustration only and are not intended to limit the scope of the invention.

BRIEF DESCRIPTION OF THE DRAWINGS

The present invention is more fully understood from the detailed description and accompanying drawings, wherein.

DETAILED DESCRIPTION OF THE INVENTION

The following description of the invention is merely exemplary in nature and is in no way intended to limit the invention, its application, or uses.

Figure 1:
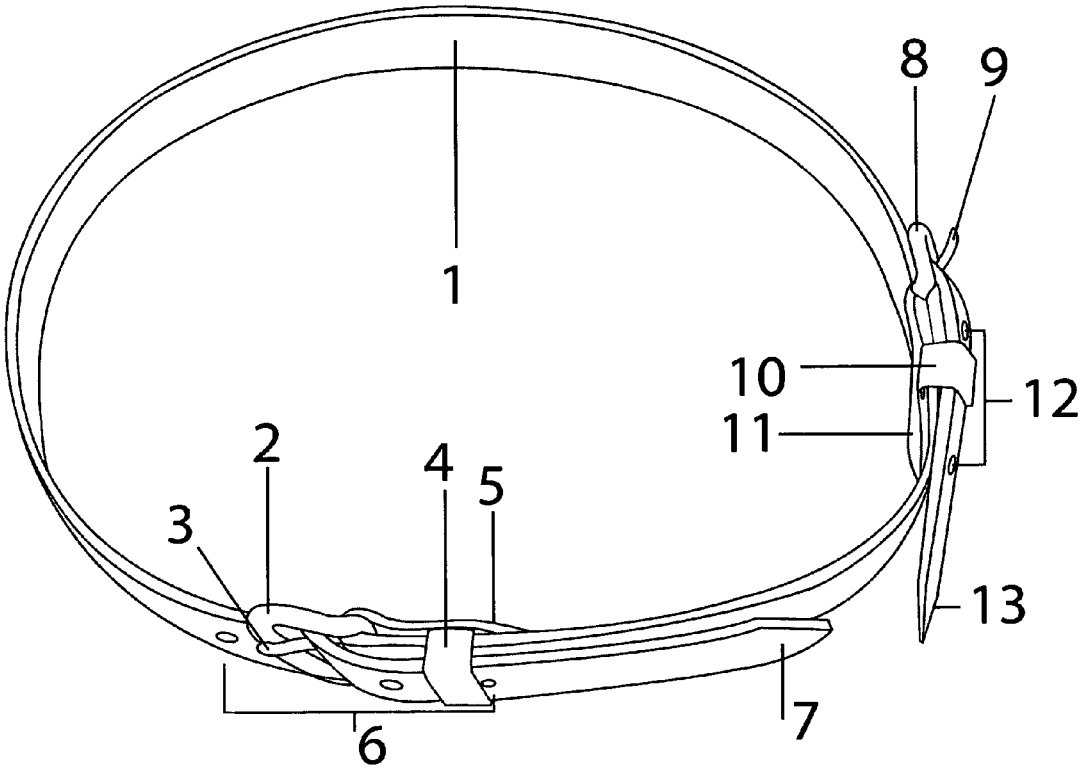
FIG. 1 is a top view of an exemplary embodiment of the belt with the belt's mated-end portions attached to one another.
Figure 5:
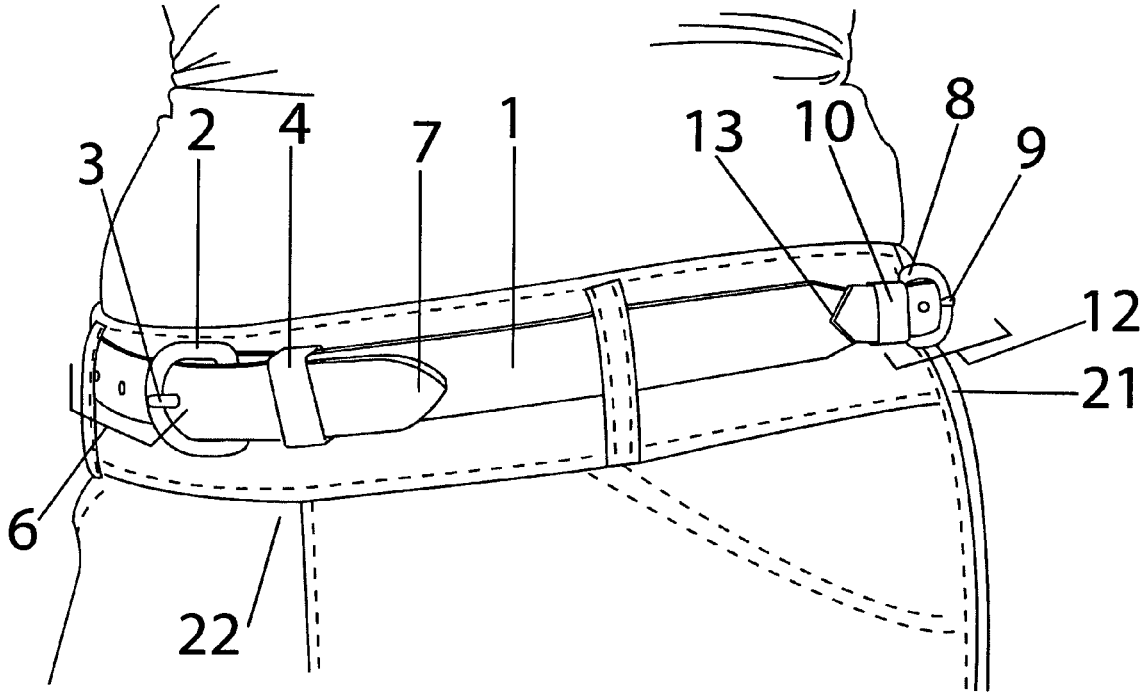
FIG. 5 is a view of the belt being used on a garment (equestrian side-zip breeches) according to an exemplary embodiment of the invention.

FIG. 1 and FIG. 5 illustrate an exemplary belt 1 in accordance with the principles of this invention. As shown in FIG. 5, the belt 1 is used with side zipper equestrian riding breeches. The belt can also be used with a wide range of other side zip garments such as pants, trousers, shorts, skirts and the like.

As shown in FIG. 5, the belt 1 is positioned on a garment (equestrian riding breeches) so that the larger buckle 2, keeper 4, and English-pointed billet end 7 are over the front seam of the garment 22; and the smaller buckle 8, keeper 10, and English-pointed billet end 13 at a 90 degree angle from the front seam and positioned over the garment's side zipper 21. The belt length is adjustable from either buckle or billet end through the respective five 6 or three 12 prong holes 3, 9 and thereby, the belt 1 is able to fit high, natural, or low waist garments. The belt can be fastened or unfastened from either buckle 2, 8 and billet end 7, 13 and thereby, overcomes the disadvantages and limitations of a traditional single buckle and billet belt.

Figure 2:
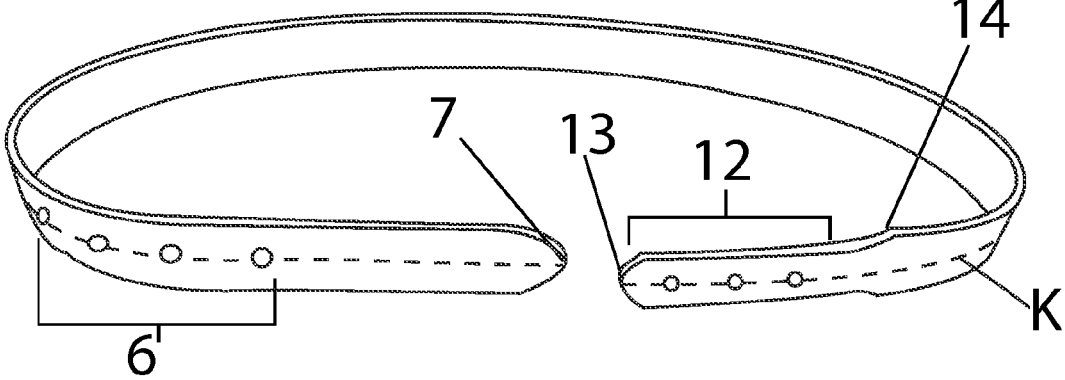
FIG. 2 is a frontal view of the belt's billet section.
Figure 3:
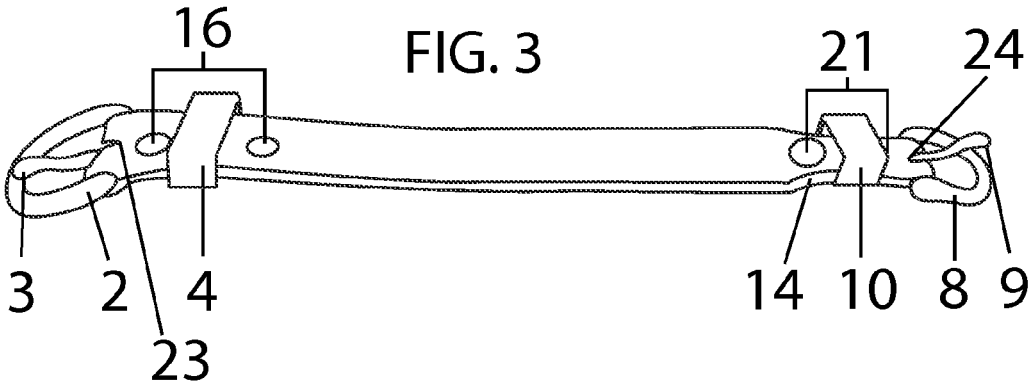
FIG. 3 is a frontal view of the belt's buckle section.

As shown in FIG. 2 and FIG. 3, the belt consists of two sections: a first belt piece or section with two billet ends, see FIG. 2; and a second, shorter belt piece or section (i.e. said second belt piece has a longitudinal length less than a longitudinal length of the first belt piece) with two buckle ends, see FIG. 3. As shown in FIG. 2, the exemplary embodiment uses one inch wide, English-pointed 7 leather belting tapered to a four inch long, three-quarter inch wide English-pointed end 14, 13. The exemplary embodiment of FIGS. 2 and 3 uses English-style bridle leather and the exemplary embodiment of FIG. 3 uses solid brass, nickel, or stainless steel hardware designed for equine tack such as bridles and martingales. As shown in FIG. 3, the exemplary embodiment uses a one inch buckle 2 and keeper 4 and a three-quarter inch buckle 8 and keeper 10 of the same style. As also illustrated and disclosed in FIG. 3, the smaller buckle 8 is attached to an end portion of leather belting 18 that is narrower than the end portion of belting 18 attached to the larger buckle 2. The exemplary embodiment uses a #69 buckle of solid brass, nickel or stainless steel 2, 8 and a matching metal keeper 4, 10. As shown in FIGS. 2 and 3, the billet end section has five holes 6 punched in the wider, English-pointed end 7 to receive the prong 3 of the larger buckle 2 of the buckle section and three holes 12 punched in the tapered English-pointed end 13, 14 to receive the prong 9 of the smaller buckle 8.

Figure 4:
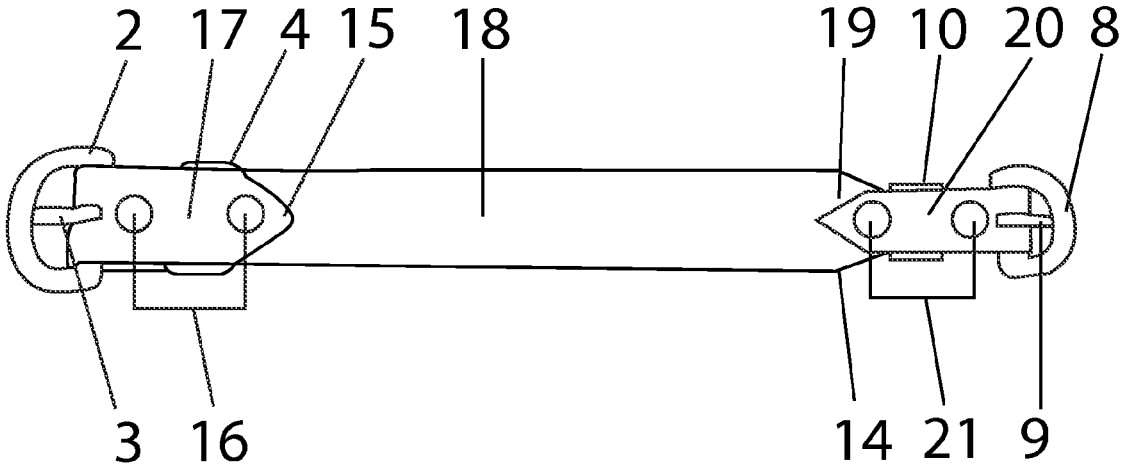
FIG. 4 is a reverse view of the belt's buckle section.

As shown in FIGS. 1, 3 and 4, the buckle section is made by skiving the flesh (rough) side of the leather belting 18 at either end 5, 11 until it is one-half the thickness of the belting 5, 11. Slots 23, 24 are then punched for the prongs 3, 9 of the buckles 2, 8 and the ends are English-pointed 15, 19. The grain (smooth) side of the belting is then folded over 17, 20 and the prongs of the buckles 3, 9 are inserted and the buckles 2, 8 and keepers 4, 10 are sandwiched between the skived flesh sides of the belting. The folded-over sections 17, 20 are then attached with double cap rivets 16, 21. The exemplary embodiment shows the buckles 2, 8 and keepers 4, 10 being attached with double cap rivets 16, 21 however, the buckles 2, 8 and keepers 4, 10 can also be attached by stitching with thread or stitching and rivets may be used together to attach the buckles and keepers.

What is claimed is:

1. A belt consisting of:

a first belt piece comprising a first longitudinal axis, a first billeted end portion with a first plurality of belt holes spaced apart, and a second billeted end portion with a second plurality of belt holes spaced apart, wherein a first width of the first billeted end portion, when taken normal to the first longitudinal axis and across a center of one of the first plurality of holes, is greater than a second width of the second billeted end portion when taken normal to the first longitudinal axis and across a center of one of the second plurality of holes, said first belt piece comprising a single piece of material;

a first buckle assembly comprising a first buckle sized to fit the first billeted end portion of the first belt piece, and a prong;

a second buckle assembly comprising a second buckle sized to fit the second billeted end portion of the first belt piece, said second buckle being smaller than said first buckle, and a prong;

a second belt piece comprising a first end portion attached to the first buckle assembly, a second end portion attached to the second buckle assembly, said second end portion being narrower than the first end portion, said second belt piece having a longitudinal length less than a longitudinal length of the first belt longitudinal length piece, said second belt piece comprising a single piece of material; and wherein the second buckle assembly is positioned at about a 90° angle from the first buckle assembly when said first buckle assembly of said second belt piece is removably engaged with the first billeted end portion of said first belt piece and said second buckle assembly of said second belt piece is removably engaged with the second billeted end portion of said first belt piece, and when engaged, said first belt piece, said second belt piece, said first buckle assembly and said second buckle assembly configured to allow the first buckle assembly to be positioned at the front center of a wearer's body and the second buckle assembly to be positioned at the side of the wearer's body above a side zipper of a garment.

2. The belt of claim 1 wherein the dimensions of the spacing between belt holes on the second billeted end portion differ from the dimensions of the spacing between belt holes on the first billeted end portion.

3. The belt of claim 2 wherein the second billeted end portion of the first belt piece is approximately four inches long.

4. The belt of claim 2 wherein the second billeted end portion of the first belt piece contains at least three belt holes spaced apart by approximately three-quarters of one inch.

5. The belt of claim 2 wherein the second billeted end portion of the first belt piece is cut to approximately 75% of the width of the remainder of the first belt piece, and wherein the second end of the second belt piece is cut to approximately 75% of the width of the remainder of the second belt piece and the second buckle is approximately 75% of the width of the first buckle.

* * * * *